US008419269B2

(12) United States Patent
Hiranuma

(10) Patent No.: US 8,419,269 B2
(45) Date of Patent: Apr. 16, 2013

(54) PORTABLE TIMEPIECE

(75) Inventor: Haruki Hiranuma, Chiba (JP)

(73) Assignee: Seiko Instruments Inc. (JP)

( * ) Notice: Subject to any disclaimer, the term of this patent is extended or adjusted under 35 U.S.C. 154(b) by 198 days.

(21) Appl. No.: 13/065,665

(22) Filed: Mar. 25, 2011

(65) Prior Publication Data

US 2011/0235476 A1 Sep. 29, 2011

(30) Foreign Application Priority Data

Mar. 26, 2010 (JP) ..... 2010-073331

(51) Int. Cl.
*G04B 37/00* (2006.01)

(52) U.S. Cl.
USPC ..... 368/291

(58) Field of Classification Search ..... 368/281, 368/286–292, 309
See application file for complete search history.

(56) References Cited

U.S. PATENT DOCUMENTS 2,507,974 A * 5/1950 Georges ..... 368/288
3,040,514 A * 6/1962 Dinstman ..... 368/289
3,535,869 A * 10/1970 Strigini et al. ..... 368/289
8,303,168 B2 * 11/2012 Takasawa ..... 368/280
2005/0259521 A1 * 11/2005 Ho ..... 368/281

OTHER PUBLICATIONS

Patent Abstracts of Japan, publication No. 05-172956, publication date Jul. 13, 1993.

* cited by examiner

*Primary Examiner* — Edwin A. Leon
(74) *Attorney, Agent, or Firm* — Adams & Wilks

(57) ABSTRACT

To provide a portable timepiece in which water is not easily allowed to enter the timepiece exterior assembly with the completion of venting, the timepiece is equipped with a vent valve mounted to a timepiece exterior assembly. The vent valve is equipped with a valve body holder fixed to the timepiece exterior assembly, a ring-shaped packing supported by the holder and elastically deformable, and a valve body movable between a valve-closed position and a valve-open position. The valve body has a valve body shaft portion, a valve body head integral with this shaft portion, and an exhaust recess formed in the valve body shaft portion. The valve body shaft portion axially extends through the valve body holder while in contact with the inner peripheral portion of the packing. Through movement of the valve body, the exhaust recess is detached from the packing at the valve-closed position, and, at the valve-open position, the exhaust recess is arranged so as to be astride and cross apart of the inner peripheral portion of the packing.

6 Claims, 6 Drawing Sheets

PORTABLE TIMEPIECE

BACKGROUND OF THE INVENTION

1. Field of the Invention

The present invention relates to a portable timepiece in which there is a possibility of the inner pressure of the timepiece exterior assembly being increased as in the case, for example, of a diver's watch suitable for saturation diving.

2. Description of the Prior Art

There is known a diver's watch for saturation diving in which, to cope with a case where the inner pressure of the timepiece exterior case has become higher than the outer pressure thereof, a button of a vent valve provided in the case is artificially depressed, thereby forcibly discharging the gas inside the timepiece exterior case to the exterior of the case (See, for example, JP-A-5-172956).

The vent valve with which this diver's watch is equipped has a stepped hole formed in the case band of the timepiece exterior case, a button, a retaining ring, a coil spring, and packing.

A small diameter hole portion of the stepped hole is open to the inner side of the case band, and a large diameter hole portion of the stepped hole is open to the exterior of the case band. The button has an operating portion fit-engaged with the large diameter hole portion, and a shaft portion extending through the small diameter hole portion. The retaining ring preventing detachment of the button from the stepped hole is connected to the shaft portion inside the timepiece exterior case. The coil spring is accommodated in the large diameter hole portion while fitted onto the shaft portion, urging the button toward the outer side of the case band. The packing is fixed to the shaft portion. In the normal state in which the button is not pushed in, this packing is in contact with the inner surface of the small diameter hole portion or of a pipe attached to this hole portion to exhibit interference; in the state in which the button has been pushed in, it is arranged inside the case band without exhibiting any interference.

Thus, simultaneously with the pushing-in operation of the button, the packing is moved so as to be detached from the small diameter hole portion of the stepped hole into the interior of the case band, and communication is established between the interior and exterior of the case band via the stepped hole. As a result, the gas inside the timepiece exterior case can be discharged to the exterior of this case via the stepped hole.

SUMMARY OF THE INVENTION

In the situation in which the vent valve of the diver's watch of Patent Document 1 is operated after saturation diving, there is the possibility of some water being accumulated in the large diameter hole portion of the stepped hole, and the water adhering to the wet hand of the diver may be allowed to enter the large diameter hole portion. Further, in the case of the vent valve pushing-in operation in rainy weather, rain water may be allowed to enter the large diameter hole portion. When the exhaust operation is performed in such a situation, the pushing-in of the button is being continued immediately after the completion of the exhaust; and, since the packing has no interference, there is a fear of the water in the large diameter hole portion being allowed to enter the timepiece exterior case in this state.

As described above, the prior-art technique has a problem in that there is a fear of water being allowed to enter the case band with the completion of the venting.

To solve the above problem, there is provided, according to the present invention, a portable timepiece to whose timepiece exterior assembly there is mounted a vent valve for allowing a gas pressure within it to escape to the exterior, wherein the vent valve comprises: a valve body holder fixed to the timepiece exterior assembly so as to establish communication between the interior and exterior of the timepiece exterior assembly; packing formed in a ring-like configuration of a seal material capable of elastic deformation and supported by the valve body holder; and a valve body movable between a valve-closed position and a valve-open position and equipped with a valve body shaft portion axially extending through the valve body holder while in contact with an inner peripheral portion of the packing, a valve body head provided integrally with the shaft portion, and an exhaust recess formed in the valve body shaft portion so as to be open in a peripheral surface of the shaft portion and adapted to be detached from the packing at the valve-closed position and to cross, at the valve-open position, a part of the inner peripheral portion of the packing so as to be astride this part.

In the present invention, it is desirable for the vent valve to be provided in the case band portion of the timepiece exterior assembly; however, it may also be provided in some other place than the case band portion. In the present invention, the valve body may be of a pushing operation type valve body in which it is moved from the valve-closed position to the valve-open position through pushing-in operation and in which it is moved from the valve-open position to the valve-closed position by the urging force of a spring, or a rotary operation type valve body in which the valve body is moved between the valve-closed position and the valve-open position through a change in a mesh engagement state of a male screw portion and a female screw portion through peripheral rotation of the valve body.

In the present invention, the term valve-closed position implies the arrangement of the valve body in which it has been moved so as to hinder venting, and the term valve-open position implies the arrangement of the valve body in which it has been moved so as to allow venting.

In the present invention, the exhaust recess of the valve body is one or more in number, and this exhaust recess can be formed by a groove of, for example, a circular, elliptical, oval, square, or rectangular configuration so as to occupy a partial region of the peripheral surface of the valve body shaft portion, or a groove or the like extending in the axial direction of the valve body shaft portion.

Further, in the present invention, the depth of the exhaust recess may or may not be equal to the interference of the packing with respect to the peripheral surface of the valve body shaft portion (that is, the difference between the inner diameter of the packing in the free state and the inner diameter of the packing in the state in which it has undergone elastic deformation to come into contact with the valve body shaft portion); this depth is increased when shortening the requite time of venting, and reduced when lengthening the time.

In the normal state of the portable timepiece of the present invention, the valve body is arranged at the valve-closed position, so that the vent valve is closed. That is, at a position spaced apart from the exhaust recess formed in the valve body shaft portion, the entire inner peripheral portion of the packing is continuously held in intimate contact with the peripheral surface of the valve body shaft portion. When, in this state, there is conducted, for example, saturation diving, high pressure is exerted from the exterior of the timepiece exterior assembly; however, due to the above-mentioned intimate contact, the seal performance of the vent valve is maintained. On the other hand, the seal material permeating gas such as helium gas used in the saturation diving is permeated through the packing or the like, so that the inner pressure of the timepiece exterior assembly is increased.

To remove the inner pressure of the timepiece exterior assembly after diving or the like, the vent valve is opened. That is, the valve body head is operated so as to open the vent valve, and the valve body is moved from the valve-closed position to the valve-open position. As a result, the valve body is arranged such that the exhaust recess crosses the inner peripheral portion of the packing, and the inner peripheral portion of the packing is brought into intimate contact with the peripheral surface of the valve body shaft portion except for the exhaust recess.

In this state, communication is established between the interior of the timepiece exterior assembly, which is on the upstream side of the packing with respect to the gas flow at the time of venting, and the exterior of the timepiece exterior assembly, which is on the downstream side of the packing, via the exhaust recess. Thus, the gas in the timepiece exterior assembly is discharged to the exterior of the timepiece exterior assembly.

In this venting, the path allowing outflow of gas is restricted to the exhaust recess, and the inner peripheral portion of the packing is held in intimate contact with the peripheral surface of the valve body shaft portion except for the exhaust recess, thus effecting sealing between the valve body shaft portion and the valve body holder. Thus, even if water has entered the downstream side of the packing with respect to the gas flow at the time of venting, it is possible to reduce the possibility of this water entering the interior of the timepiece exterior assembly immediately after the venting.

In a preferred mode of the portable timepiece according to the present invention, the vent valve is equipped with a return spring urging the valve body toward the valve-closed position; and the valve body can be pushed in toward the valve-open position.

In this preferred mode of the invention, the valve body is moved from the valve-closed position to the valve-open position through the one-touch operation of pushing in the valve body to make it advantageously possible to effect venting through the vent valve.

In a preferred mode of the portable timepiece of the present invention, the vent valve is equipped with a spring bearing plate holding the packing between itself and a packing bearing portion of the valve body holder, and the return spring is arranged between the spring bearing plate and the valve body head.

In this preferred mode of the invention, as the return spring is further compressed through the operation of opening the vent valve, the packing held between the vent valve and the packing bearing portion undergoes further elastic deformation via the spring bearing plate, so that the inner peripheral portion of this packing is brought more firmly into intimate contact with the peripheral surface of the valve body shaft portion in a state in which it crosses the exhaust recess. As a result, the seal performance is improved, and, with that, it is further advantageously possible to reduce the possibility of water entering the interior of the timepiece exterior assembly immediately after the venting.

In a preferred mode of the portable timepiece of the present invention, the valve body holder has a male screw portion, and the valve body head has a female screw portion threadedly engaged with the male screw portion; and through a change in the threaded engagement of the male screw portion and the female screw portion, the valve body can move between the valve-closed position and the valve-open position, with the valve body head being provided with a vent hole.

In this preferred mode of the invention, by rotating the valve body, the valve body is moved from the valve-closed position to the valve-open position or vice versa, making it possible to open and close the vent valve. Thus, it is possible to further reduce the possibility of water entering the interior of the timepiece exterior assembly immediately after the opening of the vent valve for venting.

In a preferred mode of the portable timepiece of the present invention, the exhaust recess is deeper than the interference of the packing.

In this preferred mode of the invention, when the valve body is moved to the valve-open position to open the vent valve, a portion of the packing opposed to the exhaust recess is restored; however, the exhaust recess is not completely closed by this restored portion. Thus, it is advantageously further possible to perform venting reliably in a short time.

In a preferred mode of the portable timepiece of the present invention, the exhaust recess is a groove extending in the axial direction of the valve body shaft portion.

In this preferred mode of the invention, the width of the exhaust recess is small, and, with that, it is possible to secure a longer length of the packing held in intimate contact with the peripheral surface of the valve body shaft portion in a state in which the valve body is moved to the valve-open position, so that it is advantageously further possible to reduce the water entering the interior of the timepiece exterior assembly immediately after the venting while maintaining the venting performance.

According to the present invention, it is possible to provide a portable timepiece in which water does not easily enter the timepiece exterior assembly with the completion of venting.

DETAILED DESCRIPTION OF THE PREFERRED EMBODIMENTS

In the following, the first embodiment of the present invention will be described in detail with reference to FIGS. 1 through 4.

Figure 1:
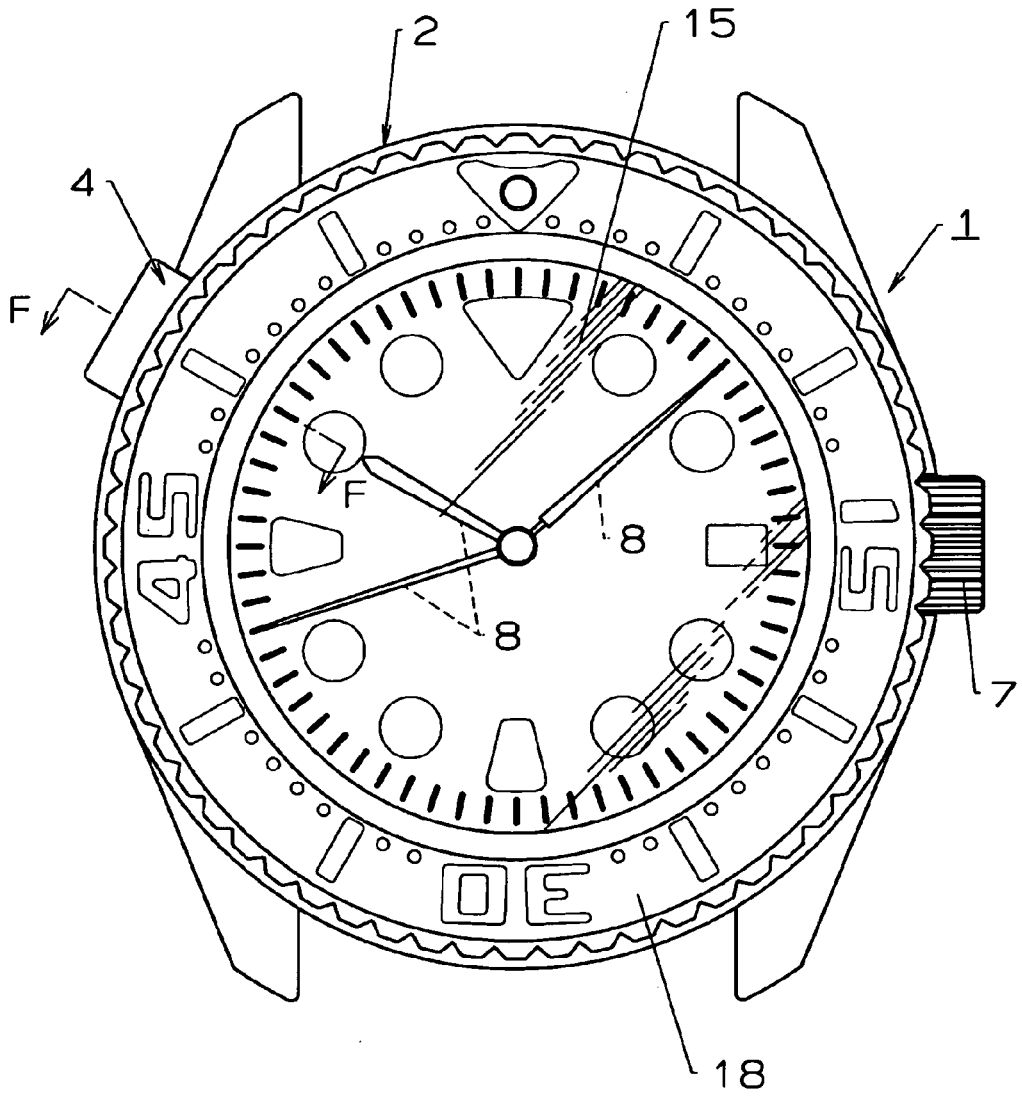
FIG. 1 is a plan view of a wristwatch according to a first embodiment of the present invention.
Figure 2:
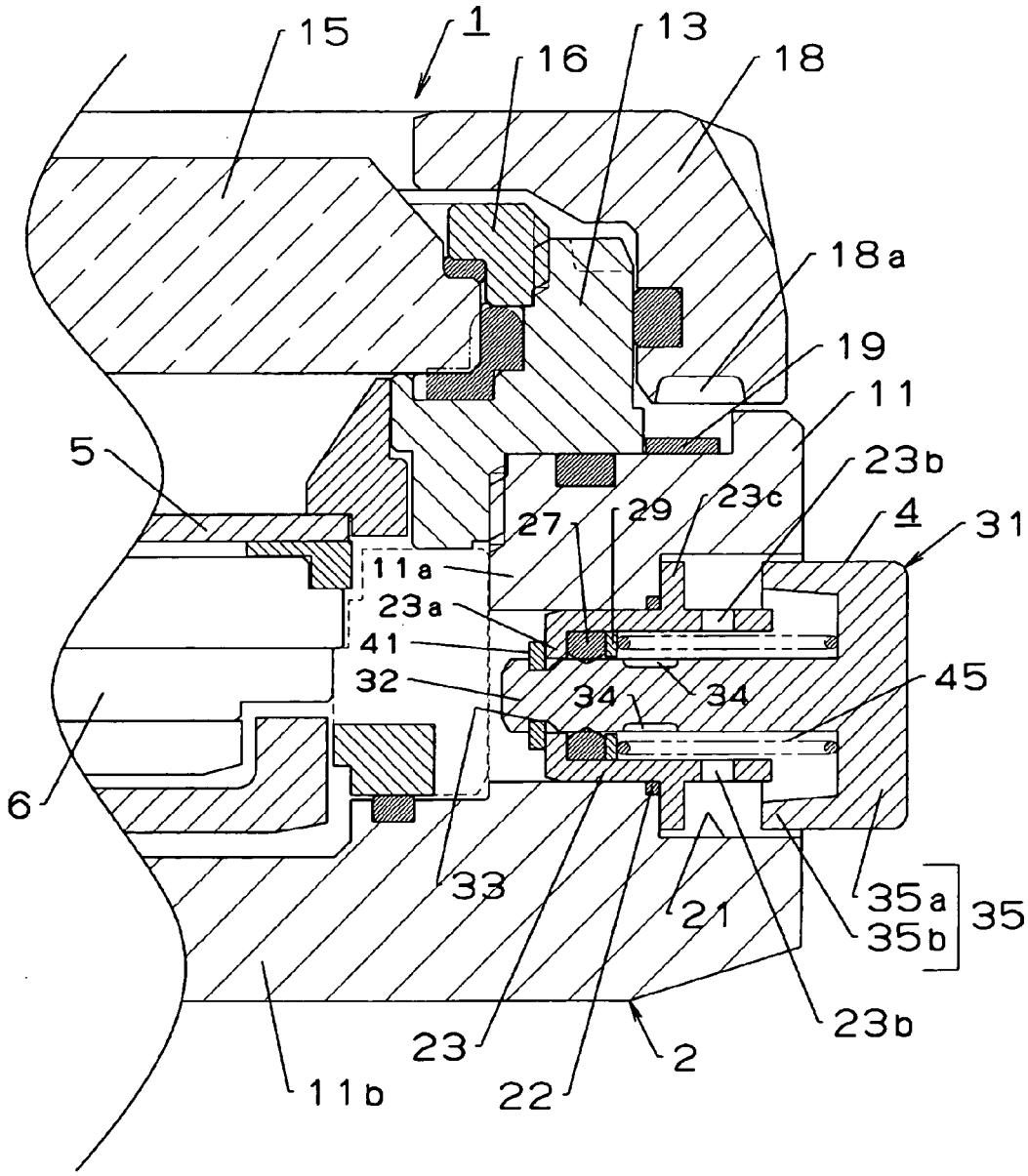
FIG. 2 is a sectional view, taken along the line F-F of FIG. 1, of the wristwatch of the first embodiment with a vent valve thereof closed.
Figure 3:
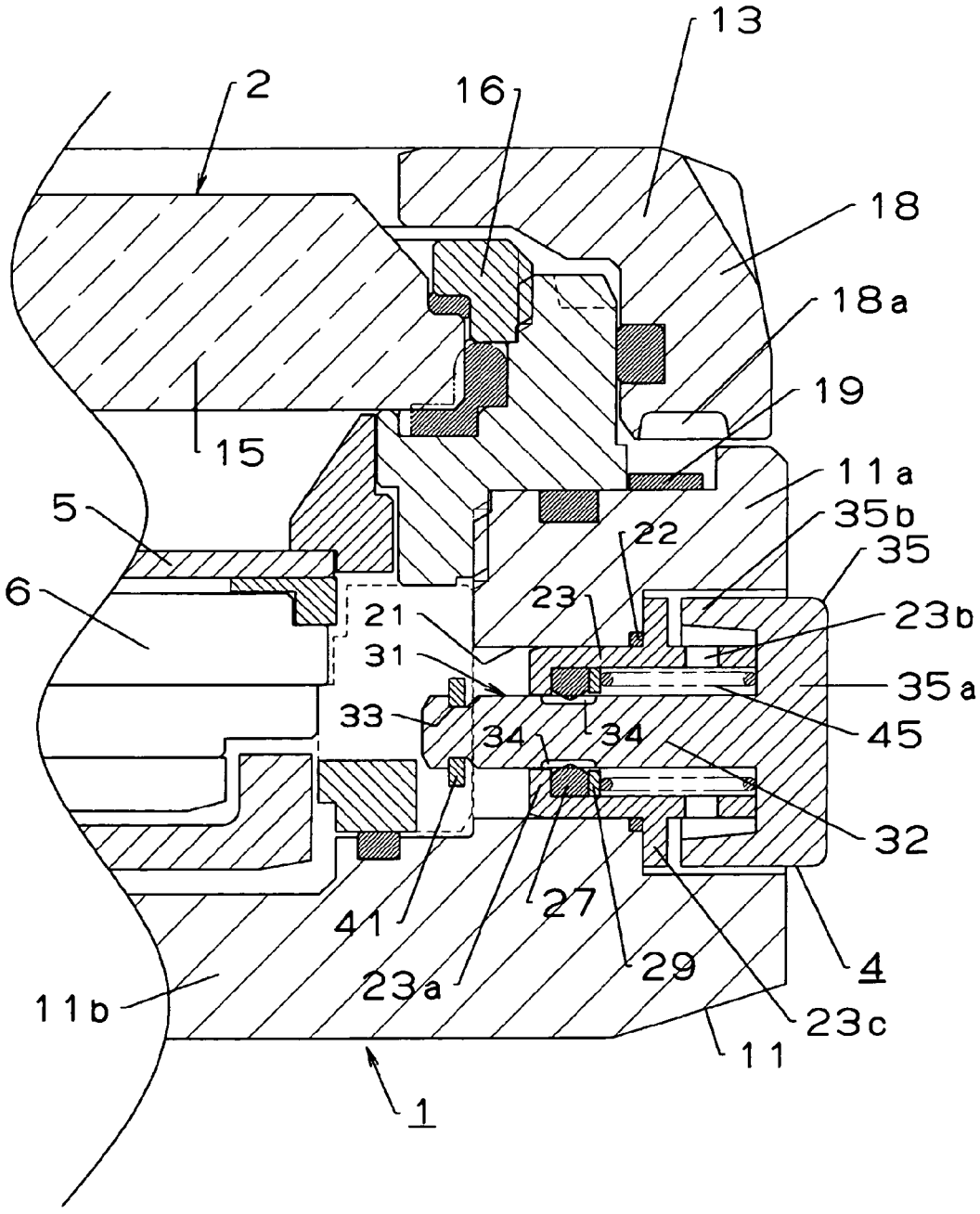
FIG. 3 is a sectional view, taken along the line F-F of FIG. 1, of the wristwatch of the first embodiment with the vent valve thereof open.

In FIGS. 1 through 3, numeral 1 indicates a portable timepiece such as a wristwatch like a diver's watch also suitable, for example, for saturation diving. The wristwatch 1 is formed by mounting to a timepiece exterior assembly 2 a vent valve 4 for reducing the inner pressure of the timepiece exterior assembly 2. At the same time, as shown in FIGS. 2 and 3, the timepiece exterior assembly 2 contains, for example, a timepiece display plate 5 such as a dial, and a movement 6 driving timepiece display hands 8 (See FIG. 1); further, as shown in FIG. 1, a crown 7 is mounted to the peripheral portion of the timepiece exterior assembly 2.

As shown in FIGS. 2 and 3, the timepiece exterior assembly 2 is equipped with a metal exterior member 11 formed by integrating a case band portion 11*a* and a case back portion 11*b*, a glass support member 13, and a cover glass 15. Instead of the exterior member 11, it is also possible to employ a timepiece exterior assembly 2 in which a case band corresponding to the case band portion 11*a* is threadedly engaged with a separate case back corresponding to the case back portion 11*b*.

The glass support member 13 is of a ring-like configuration, and is threadedly engaged with the case band portion 11*a* from the front side thereof. The cover glass 15 is attached to the inner side of the glass support member 13 in a liquid-tight fashion, and the back surface thereof faces the timepiece display plate 5. Numeral 16 indicates a glass fixation ring threadedly engaged with the glass support member 13 to mount the cover glass 15.

Mounted to the timepiece exterior assembly 2 is a ring-shaped rotary bezel 18 capable of rotation along the outer periphery of the glass support member 13. The rotary bezel 18 is maintained at rest at an arbitrary rotating position through engagement of a lock member (not shown) of a lock spring 19 fixed to the case band portion 11*a* with engagement grooves 18*a* (only one of which is shown) provided on the back surface thereof at a fixed interval along the peripheral direction.

As shown in FIGS. 2 and 3, there is provided, for example, in the case band portion 11*a*, of the timepiece exterior assembly 2, a valve mounting hole 21 so as to establish communication between the interior and exterior of the timepiece exterior assembly 2. The valve mounting hole 21 consists of a stepped circular hole, one end of a large diameter of which is open in the outer surface of the timepiece exterior assembly 2, for example, the outer surface of the case band portion 11*a*, and the other end of a small diameter of which is open to the interior of the timepiece exterior assembly 2.

The vent valve 4 is equipped with a valve body holder 23, packing 27, a spring bearing plate 29, a valve body 31, a retaining member 41, and a return spring 45.

The valve body holder 23 consists of a metal cylindrical body both longitudinal ends of which are open, and has a stopper portion 23*a* at one longitudinal end portion thereof, and a plurality of vent holes 23*b* at the other longitudinal end portion thereof, with a flange portion 23*c* being provided between them and the vent holes 23*b*. The stopper portion 23*a* consists of a pipe end wall formed by inwardly bending an end portion of the valve body holder 23 facing the interior of the timepiece exterior assembly 2, which, however, should not be construed restrictively. While in this embodiment the stopper portion 23*a* also serves as the packing bearing portion, it is also possible for the stopper portion 23*a* and the packing bearing portion to be provided separately.

The valve body holder 23 is inserted into the valve mounting hole 21 from the outside of the case band portion 11*a* until the flange portion 23*c* thereof abuts the step portion of the valve mounting hole 21, and is fixed to the case band portion 11*a* by a brazing material 22.

The packing 27 is formed in a ring-like configuration of a seal material capable of elastic deformation such as synthetic rubber and elastomer. The radial sectional configuration of the packing 27 is of a shogi-piece-like configuration; while the inner peripheral portion thereof is substantially triangular, the sectional configuration of the packing 27 is not restricted to this. The packing 27 is arranged on the inner side of the valve body holder 23. More specifically, the packing 27 is arranged in the valve body holder 23 while in contact with a corner portion formed by the stopper portion 23*a* also serving as the packing bearing portion and the inner peripheral surface of the valve body holder 23 continuous at right angles with the stopper portion 23*a*.

The spring bearing plate 29 consists of a ring-shaped flat plate formed of metal or synthetic resin. The spring bearing plate 29 is arranged on the inner side of the valve body holder 23 while holding the packing 27 between itself and the stopper portion (packing bearing portion) 23*a*.

The valve body 31 is formed of metal, and has the valve body shaft portion 32, the exhaust recess 34, and the valve body head 35.

The valve body shaft portion 32 is of a columnar configuration. The valve body shaft portion 32 is long enough to axially extend through the valve body holder 23. A member attachment groove 33 is formed atone end portion constituting the forward end of the valve body shaft portion 32, that is, the end portion on the interior side of the timepiece exterior assembly 2.

A plurality of, e.g., two, exhaust recesses 34 are provided between the member attachment groove 33 and the valve body head 35 and so as to be spaced apart from each other by 180 degrees in the peripheral direction of the valve body shaft portion 32. The exhaust recesses 34 are formed by grooves open in the peripheral surface of the valve body shaft portion 32 and extending in the axial direction of the valve body shaft portion 32. With the valve body 31 being arranged at the valve-close position described below, the exhaust recesses 34 are arranged apart on the downstream side of the packing 27 with respect to the gas flow at the time, for example, of venting; at the same time, with the valve body 31 being arranged at the valve-open position described below, it is situated so as to cross and be astride a part of the inner peripheral portion of the packing 27.

Figure 4A:
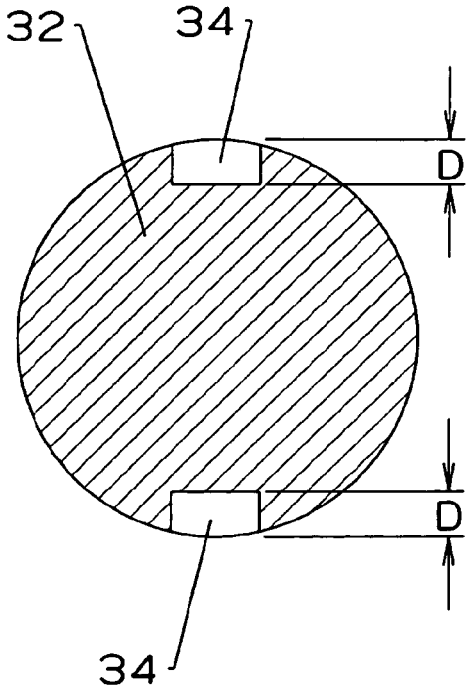
FIG. 4A is a sectional view of a valve body according to a first mode with which the vent valve of the wristwatch of the first embodiment is provided.
Figure 4B:
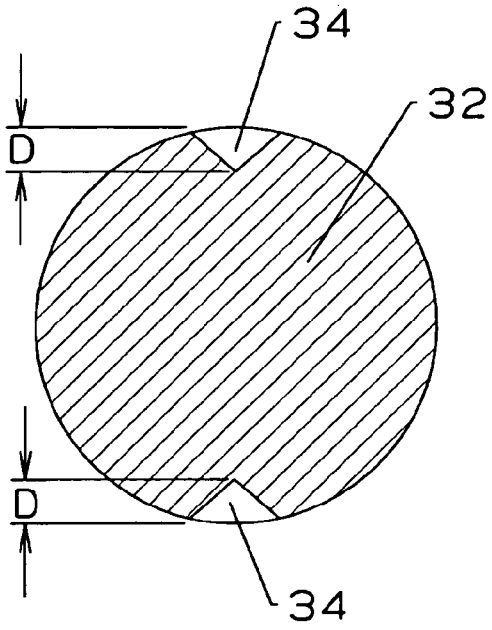
FIG. 4B is a sectional view of a valve body according to a second mode with which the vent valve is provided.

The depth D of the exhaust recesses 34 shown in FIGS. 4(A) and 4(B) is larger than the interference of the packing 27. The shape of the exhaust recesses 34 in the direction orthogonal to the longitudinal direction thereof may, for example, be a substantially U-shaped configuration as shown in FIG. 4(A) or a substantially V-shaped configuration as shown in FIG. 4(A).

The valve body head 35 is provided integrally with the valve body shaft portion 32. The valve body head 35 is formed by an end wall portion 35*a* protruding at right angles from the outer periphery of the valve body shaft portion 32, and a cylinder portion 35*b* provided so as to be bent at the end wall portion 35*a*. The cylinder portion 35*b* is substantially parallel to the valve body shaft portion 32, and forms an annular groove between itself and the other end portion of the valve body shaft portion 32. The outer diameter of the cylinder portion 35*b* is smaller than that of the large diameter hole portion of the valve mounting hole 21, and an annular gap can be formed between them.

The valve body shaft portion 32 of the valve body 31 of the construction described above axially extends through the valve body holder 23, and the cylinder portion 35*b* is inserted into the large diameter hole portion of the valve mounting hole 21. Thus, the valve body shaft portion 32 extends through the stopper portion 23*a* of the valve body holder 23, the packing 27, and the spring bearing plate 29. An exhaust gap is secured between the peripheral surface of the valve body shaft portion 32 and the inner periphery of the stopper portion 23*a* and of the spring bearing plate 29; the inner peripheral portion of the packing 27 undergoes elastic deformation with respect to the peripheral surface of the valve body shaft portion 32, that is, is held in intimate contact therewith while exhibiting interference. Further, the valve body 31 can move in the axial direction thereof while sliding on the inner peripheral portion of the packing 27. This axial movement of the valve body 31 is effected between the valve-closed position, where the vent valve 4 is closed, and the valve-open position, where the vent valve 4 is open.

The retaining member 41 is mounted to the valve body shaft portion 32 while engaged with the member attachment groove 33 thereof. As the retaining member 41, there is used, for example, a retaining ring such as an E-ring or a C-ring. The retaining member 41 is situated on the interior side of the case band portion 11*a* with respect to the stopper portion 23*a*, that is, on the interior side of the timepiece exterior assembly 2, and can move toward and away from the stopper portion 23*a* as the valve body 31 moves in the axial direction.

The return spring 45 is fitted onto the valve body shaft portion 32, and is arranged in a compressed state between the spring bearing plate 29 and the end wall portion 35*a*, with one end thereof being in contact with the spring bearing plate 29, and the other end thereof in contact with the end wall portion 35*a*. Due to the urging force of the return spring 45, the valve body 31 is urged such that a part of the valve body head 35 protrudes from the case band portion 11*a*, so that the valve body 31 can be pushed in toward the inner side of the case band.

In the normal state of the wristwatch 1, the vent valve 4 is in the closed state as shown in FIG. 2.

That is, due to the urging force of the return spring 45, the valve body 31 is retained in a state in which the retaining member 41 abuts the stopper portion 23*a* of the valve body holder 23 from the interior side of the timepiece exterior assembly 2. That is, the valve body 31 is arranged at the valve-closed position.

In this state, the exhaust recesses 34 are apart on the downstream side of the packing 27 with respect to the gas flow at the time of venting, and the end wall portion 35*a* side portion of the valve body head 35 protrudes outwardly from the case band portion 11*a* of the timepiece exterior assembly 2 so that this portion can be pushed in by a finger of the user. Further, in the same state, the inner peripheral portion of the ring-shaped packing 27 mounted to the valve body holder 23 is held continuously in intimate contact with the peripheral surface of the valve shaft portion 32 in an elastically deformed state, that is, in a state in which it exhibits interference.

In saturation diving, the seal member permeating gas such as helium gas used in an under-water living quarter is permeated through the seal material around the cover glass 15 and the packing 27 of the vent valve 4, so that the gas pressure inside the timepiece exterior assembly 2 is increased.

In this case, the packing 27 is supported by the stopper portion 23*a* from the side opposite to the side where the gas pressure is exerted, so that the higher the gas pressure exerted, the larger the degree to which the elastic deformation occurs. Thus, the packing 27 is more firmly held in intimate contact with the portion in which it is held in contact, thus achieving an improvement in terms of the seal performance at the vent valve 4. At the same time, the permeation of the helium gas through the packing 27 is mitigated, making it possible to suppress an increase in the inner pressure of the timepiece exterior assembly 2. For a similar reason, also in a case in which the water pressure exerted upon the packing 27 during diving is increased, the seal performance at the vent valve 4 is improved with that, so that it is possible to reliably suppress intrusion of water such as sea water into the timepiece exterior assembly 2 via the vent valve 4.

After surfacing from the under-water living quarter, the user pushes the valve body head 35 to move the valve body 31 toward the interior of the timepiece exterior assembly 2, whereby it is possible to discharge to the exterior of the timepiece exterior assembly 2 the high pressure gas having entered the timepiece exterior assembly 2 prior to that.

That is, FIG. 3 shows a state in which the valve body 31 has been pushed in to a maximum degree against the urging force of the return spring 45 to move the valve body 31 to the valve-open position. When the valve body 31 is pushed in to a maximum degree toward the interior of the timepiece exterior assembly 2, the end wall portion 35*a* of the valve body head 35 abuts the valve body holder 23, and a further pushing-in operation is hindered.

Through this movement of the valve body 31 to the valve-open position, the exhaust recesses 34 formed in the valve body shaft portion 32 are arranged so as to be astride and cross a part of the inner peripheral portion of the packing 27. In other words, the exhaust recesses 34 are situated such that the inner peripheral portion of the packing 27 is across the exhaust recesses 34, and communication is established between the upstream side of the packing 27 with respect to the gas flow discharged from the vent valve 4, that is, the interior of the timepiece exterior assembly 2, and the downstream side of the packing 27 via the exhaust recesses 34. With that, the gas inside the timepiece exterior assembly 2 flows out, due to the pressure thereof, toward the case band outer side via the exhaust recesses 34. Further, after having passed the vent hole 23*b* of the valve holder 23, this exhaust gas is discharged to the exterior of the timepiece exterior assembly 2 via the gap between the large diameter hole portion of the valve mounting hole 21 and the valve body head 35.

Through the simple one-touch operation of pushing in the valve body 31 as described above, it is possible to move the valve body 31 from the valve-closed position to the valve-open position, making it possible to effect venting through the vent valve 4.

In this venting state, the path allowing the outflow of the gas is restricted to the exhaust recesses 34, and the inner peripheral portion of the packing 27 is held in intimate contact with the peripheral surface of the valve body shaft portion 32 except for the exhaust recesses 34. Thus, even if water has entered the downstream side of the packing 27 with respect to the gas flow at the time of venting, it is possible to reduce the possibility of this water being allowed to enter the interior of the timepiece exterior assembly 2 immediately after the venting.

Further, as described above, the valve body 31 is pushed in to the valve-open position, whereby the return spring 45 is further compressed. With that, the packing 27 held between the valve body and the stopper portion 23*a* also serving as the packing bearing portion undergoes further elastic deformation via the spring bearing plate 29, and the inner peripheral portion of the packing 27 is more firmly brought into intimate contact with the peripheral surface of the valve body shaft portion 32 while crossing the exhaust recesses 34. Thus, as the seal performance between the peripheral surface of the valve body shaft portion 32 and the packing 27 with respect to the peripheral direction thereof is improved, it is possible to further reduce the possibility of water entering the interior of the timepiece exterior assembly 2 immediately after the venting.

Moreover, since the exhaust recesses 34 are formed by grooves extending in the axial direction of the valve body shaft portion 32, the width of the exhaust recesses 34 is small. Thus, with the valve body 31 moved to the valve-open position, it is possible to secure a larger length of the packing 27 held in intimate contact with the peripheral surface of the valve body shaft portion 32. Thus, it is possible to further reduce the possibility of water entering the interior of the timepiece exterior assembly 2 immediately after venting while maintaining the venting performance.

Further, in the state in which the valve body 31 has been moved to the valve-open position, with the vent valve 4 open, a part of the packing 27 opposed to the exhaust recesses 34 is restored. However, the exhaust recesses 34 are formed deeper than the interference of the packing 27, so that the exhaust recesses 34 are not completely closed by the restored portion. Thus, it is possible to perform venting in a short time.

To restore the valve to the normal state after venting, the finger of the user pressing the valve body 31 is released from the valve body 31. As a result, the valve body 31 is moved from the valve-open position to the valve-closed position by the urging force of the return spring 45. Thus, the exhaust recesses 34 are arranged apart on the downstream side of the packing 27, and the inner peripheral portion of the packing 27 is continuously held in intimate contact with the peripheral surface of the valve body shaft portion 32 to close the vent valve 4.

The second embodiment of the present invention will be described with reference to FIGS. 5 and 6. The second embodiment is the same as the first embodiment except for the matter described below. Thus, the components that are of a construction identical with or similar to those of first embodiment are indicated by the same reference numerals, and a description thereof will be omitted.

The second embodiment is different from the first embodiment in the construction of the vent valve 4, etc.

A valve mounting hole 21 provided in the case band portion 11*a* consists of a multi-step circular hole, and a large diameter hole portion open in the outer surface of the case band portion 11*a* is of a stepped configuration with an annular step portion forming a positioning portion 21*a* at the depth thereof.

The vent valve 4 is equipped with the valve body holder 23, the packing 27, the valve body 31, and the retaining member 41.

The valve body holder 23 consists of a metal pipe, which is inserted into the valve mounting hole 21 to be brazed to the case band portion 11*a*.

The valve body holder 23 is composed of a large diameter portion and a small diameter portion. The large diameter portion of the valve holder 23 is arranged in the stepped large diameter portion of the valve mounting hole 21. A male screw portion 26 is formed in the outer periphery of the large diameter portion. The forward end portion, for example, of the small diameter portion of the valve body holder 23 constitutes a stopper portion 23*a* also serving as the packing bearing portion.

The valve body holder 23 has a packing attachment groove 23*d* open in the inner peripheral surface of the small diameter portion thereof and formed in an annular configuration to extend continuously one round around the periphery. A part of the wall forming the packing attachment groove 23*d* is the stopper portion 23*a*; however, it is also possible for the stopper portion 23*a* and the packing attachment groove 23*d* to be provided separately. The packing 27 is mounted to the packing attachment groove 23*d* by being fitted therein, and the inner peripheral portion of the packing 27 protrudes from the inner peripheral surface of the valve body holder 23.

The valve body shaft portion 32 of the valve body 31 axially extends through the valve body holder 23. Between the peripheral surface of the valve body shaft portion 32 and the inner peripheral surface of the valve body holder 23, there is secured a slight gap large enough to allow circulation of gas; this gap is axially divided by the packing 27.

The exhaust recesses 34 open in the peripheral surface of the valve body shaft portion 32 and plural in number, for example, are formed near a member attachment groove 33. The exhaust recesses 34 are moved with the axial movement of the valve body 31. As a result, when the valve body 31 is arranged at the valve-closed position shown in FIG. 5, the exhaust recesses 34 are arranged on the interior side of the packing 27 in the timepiece exterior assembly 2, in other words, on the upstream side with respect to the gas flow passing out through the vent valve 4; when the valve body 31 is arranged at the valve-open position as shown in FIG. 6, the exhaust recesses 34 are arranged so as to be astride and to cross a part of the inner peripheral portion of the packing 27.

One or more, for example, a plurality of vent holes 37 are provided in an end wall portion 35*a* of a valve body head 35 provided integrally with the valve body shaft portion 32. A cylinder portion 35*b* of the valve body head 35 is parallel to the valve body shaft portion 32. The case band outer side portion of the valve body holder 23 is inserted into an annular groove formed between the cylinder portion 35*b* and the valve body shaft portion 32.

The cylinder portion 35*b* has on the outer peripheral surface thereof an anti-slip portion 38 formed by knurling. The inner peripheral surface of the cylinder portion 35*b* has a female screw portion 39. An open end portion, for example, of the cylinder portion 35*b* constitutes an engagement portion 35*c* of the valve body head 35. As the valve body 31 is moved in the axial direction thereof, the engagement portion 35*c* can move toward and away from the positioning portion 21*a*.

The valve body 31 of the construction described above is mounted through threaded engagement of the female screw portion 39 thereof with the male screw portion 26 of the valve body holder 23. Through this mounting, the valve body shaft portion 32 is inserted into the valve body holder 23, and is arranged so as to axially extend through the valve body holder 23. Through a change in the mesh engagement of the male screw portion 26 and the female screw portion 39 caused by rotating the valve body 31 in the peripheral direction, the valve body 31 can move in the axial direction thereof.

Figure 5:
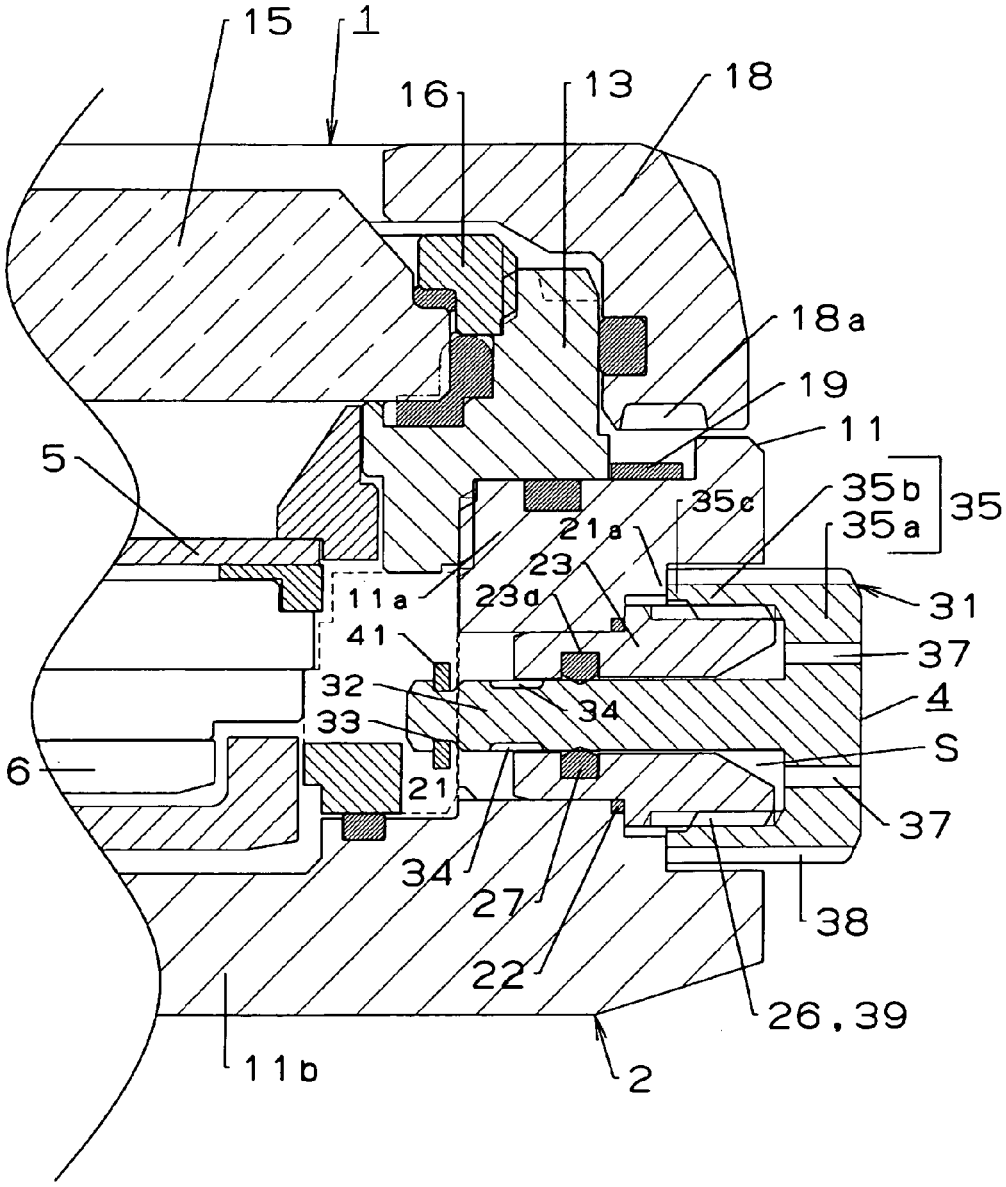
FIG. 5 is a sectional view, corresponding to FIG. 2, of a wristwatch according to a second embodiment of the present invention with a vent valve thereof closed.

In the normal state of the wristwatch 1, the vent valve 4 is in the closed state as shown in FIG. 5.

That is, the engagement portion 35*c* of the valve body head 35 is in contact with the positioning portion 21*a* of the valve mounting hole 21, regulating the maximum screwing-in depth of the valve body 31 with respect to the valve body holder 23. In other words, the mesh engagement length of the male screw portion 26 and the female screw portion 39 is maximum. In this state, the end wall portion 35*a* side portion of the valve body head 35 protrudes outwardly from the case band portion 11*a* of the timepiece exterior assembly 2 so that the user can grasp this portion by fingers and rotate the valve body 31. Further, the retaining member 41 mounted to the valve body 31 is spaced apart from the stopper portion 23*a* of the valve body holder 23.

Further, in the same state, the packing 27 mounted to the valve body 31 is held in intimate contact with the peripheral surface of the valve body shaft portion 32 continuously in the peripheral direction thereof in an elastically deformed state, that is, a state in which it exhibits interference. At the same time, an annular space S is formed by the packing 27, the valve body holder 23, and the valve body 31 on the downstream side of the packing 27 with respect to the gas flow discharged, and the vent holes 37 face this annular space S.

Thus, the annular space S communicates with the exterior of the timepiece exterior assembly 2 via each of the vent holes 37. Further, in the same state, the exhaust recesses 34 of the valve body 31 are situated between the packing 27 and the retaining member 41.

As described above, the valve body head 35 of the valve body 31 of the vent valve 4 protrudes to the exterior of the timepiece exterior assembly 2. Thus, during diving, etc., some object may be brought into contact with the valve body head 35 to push the valve body 31. In this case, the engagement portion 35*c* of the valve body head 35 is in contact with the positioning portion 21*a* of the timepiece exterior assembly 2, so that the valve body 31 is not pushed in. At the same time, unless the valve body 31 is rotated continuously, it does not move in the axial direction; and the rotation of the valve body 31 is not continued simply by pressing the valve body head 35 for a short time. Thus, even if the valve body head 35 inadvertently receives a pushing-in force, the vent valve 4 is not opened, and there is no fear of water entering the interior of the timepiece exterior assembly 2.

In saturation diving, the seal material permeating gas such as helium gas used in the under-water living quarter permeates through the seal material around the cover glass 15, and the packing 27 of the vent valve 4, so that the gas pressure inside the timepiece exterior assembly 2 is increased.

After having surfaced from the under-water living quarter, the user grasps the valve body head 35 and rotates the valve body 31 so as to loosen the threaded engagement portion, whereby it is possible to discharge the high pressure gas having entered the timepiece exterior assembly 2 to the exterior of the timepiece exterior assembly 2.

Figure 6:
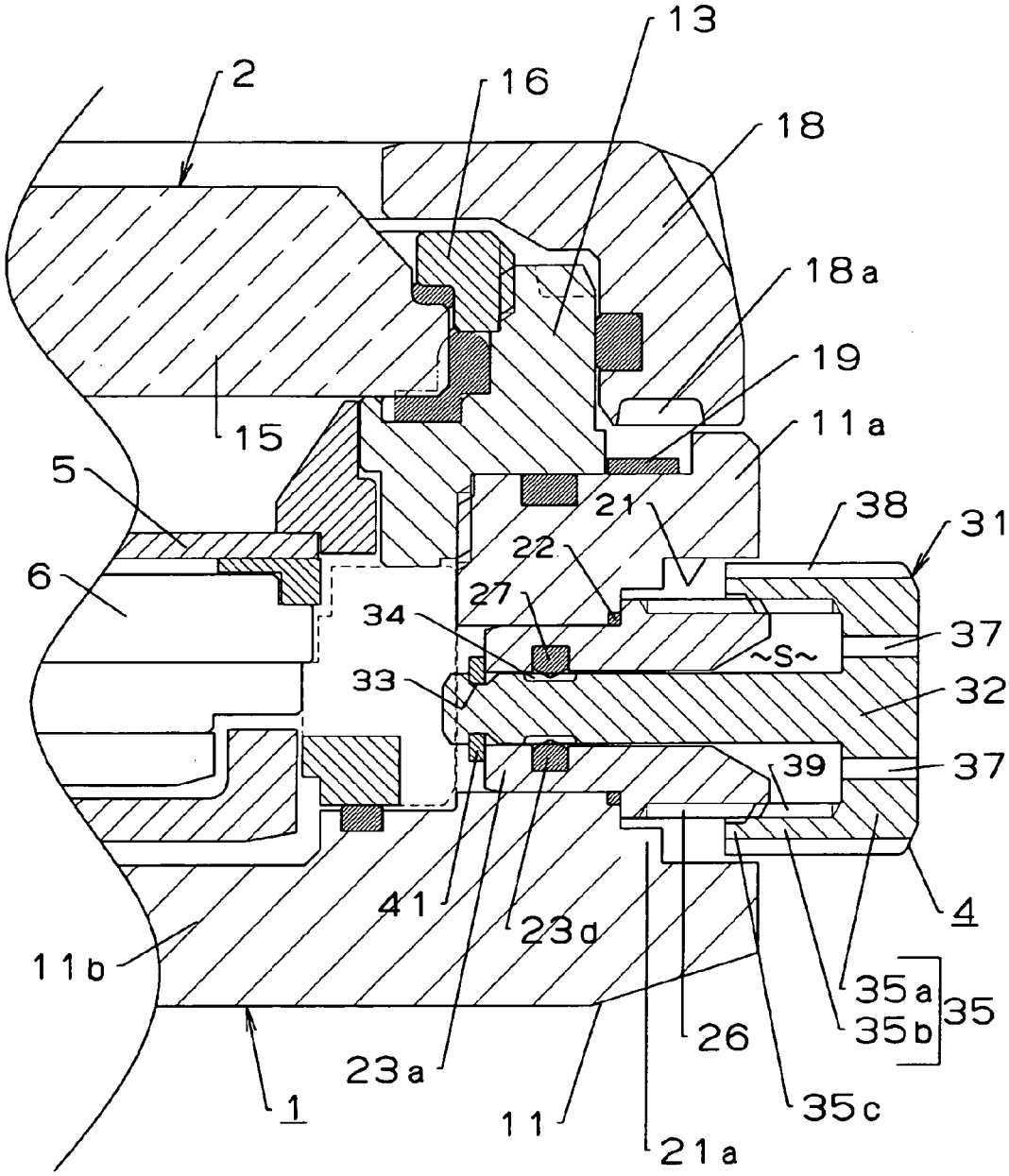
FIG. 6 is a sectional view, corresponding to FIG. 3, of the wristwatch of the second embodiment with the vent valve thereof open.

That is, through the above-mentioned rotating operation, the valve body 31 is moved so as to protrude to the exterior of the case band portion 11*a*, whereby, as shown in FIG. 6, the exhaust recesses 34 of the valve body 31 are arranged so as to be astride and cross a part of the inner peripheral portion of the packing 27, thereby opening the vent valve 4. As the vent valve 4 is thus opened, the gas inside the timepiece exterior assembly 2 is caused to circulate on the inner side of the valve body holder 23 toward the case band outer side due to the pressure thereof, and, further, passes through the vent holes 37 to be discharged to the exterior of the timepiece exterior assembly 2.

When the rotating operation to open the valve body 31 is further continued, the retaining member 41 abuts the stopper portion 23*a* from the inner side of the case band portion 11*a* as shown in FIG. 6, so that the valve body 31 is not further rotated and moved toward the case band outer side to cause detachment of the valve body 31.

During diving, most of the water having entered the annular space S through the vent holes 37 is discharged from the vent holes 37 with air displacement at the vent holes 37 after the surfacing; however, a portion of the water may remain accumulated in the annular space S. This remaining water in the vent valve 4 can be discharged to the exterior through the vent holes 37 due to the momentum of the gas discharged.

In the venting state described above, the path allowing outflow of gas is restricted to the exhaust recesses 34, and the inner peripheral portion of the packing 27 is held in intimate contact with the peripheral surface of the valve body shaft portion 32 except for the exhaust recesses 34. Thus, even if water has entered the downstream side of the packing 27 with respect to the gas flow at the time of venting, it is possible to reduce the possibility of this water entering the interior of the timepiece exterior assembly immediately after venting.

Further, in the construction of the second embodiment, at the time of venting, the main screw portion 26 of the valve body holder 23 and the female screw portion 39 of the valve body head 35 are threadedly engaged with each other, and the valve body holder 23 and the valve body head 35 maintain a state in which they form a continuous water blocking wall. Thus, even if water has been accumulated around the valve body head 35 of the valve body 31, for example, in the large diameter hole portion of the valve mounting hole 21, it is possible to prevent the water around the valve body head 35 from entering the interior of the vent valve 4 with the completion of venting, and with that, it is possible to prevent water from entering the interior of the timepiece exterior assembly 2.

To restore the vent valve to the normal state after the venting, the valve body 31 is rotated so as to be screwed in. As a result, the exhaust recesses 34 formed in the valve body shaft portion 32 are moved to the inner side of the case band portion 11*a* with respect to the packing 27, and the inner peripheral portion of the packing 27 is elastically brought into intimate contact with the peripheral surface of the valve body shaft portion 32 to close the vent valve 4.

When the vent valve 4 is closed by the above procedures, at the position where the valve body 31 has been screwed in to a maximum degree as shown in FIG. 5, the engagement portion 35*c* of the valve body head 35 is brought into contact with the positioning portion 21*a* of the valve mounting hole 21, so that, through this engagement, the operation of screwing in the valve body 31 is hindered, thus enabling the user to perceive the completion of the proper screwing-in of the valve body 31.

Further, in the construction of the vent valve 4 of the second embodiment, there is no need to provide a coil spring of a spring force (urging force) corresponding to the designated pressure for saturation diving, so that the number of components is reduced, thereby simplifying the construction.

This embodiment is the same as the first embodiment except for the matter described above. Thus, in the second embodiment also, it is possible to provide a portable timepiece such as a diver's watch which helps to solve the problem of the present invention as described above and in which water is not easily allowed to enter the timepiece exterior assembly 2 with the completion of venting.

What is claimed is:

1. A portable timepiece to whose timepiece exterior assembly there is mounted a vent valve for allowing a gas pressure within it to escape to the exterior, wherein the vent valve comprises:

a valve body holder fixed to the timepiece exterior assembly so as to establish communication between the interior and exterior of the timepiece exterior assembly;

packing formed in a ring-like configuration of a seal material capable of elastic deformation and supported by the valve body holder; and a valve body movable between a valve-closed position and a valve-open position and equipped with a valve body shaft portion axially extending through the valve body holder while in contact with an inner peripheral portion of the packing, a valve body head provided integrally with the shaft portion, and an exhaust recess formed in the valve body shaft portion so as to be open in a peripheral surface of the shaft portion and adapted to be detached from the packing at the valve-closed position and to cross, at the valve-open position, a part of the inner peripheral portion of the packing so as to be astride this part.

2. A portable timepiece according to claim 1, wherein the vent valve is equipped with a return spring urging the valve body toward the valve-closed position; and the valve body is provided so as to be capable of being pushed in toward the valve-open position.

3. A portable timepiece according to claim 2, wherein the vent valve is equipped with a spring bearing plate holding the packing between itself and a packing bearing portion of the valve body holder; and the return spring is arranged between the spring bearing plate and the valve body head.

4. A portable timepiece according to claim 1, wherein the valve body holder has a male screw portion, and the valve body head has a female screw portion threadedly engaged with the male screw portion; and through a change in the threaded engagement of the male screw portion and the female screw portion, the valve body can move between the valve-closed position and the valve-open position, with the valve body head being provided with a vent hole.

5. A portable timepiece according to claim 1, wherein the exhaust recess is deeper than the interference of the packing.

6. A portable timepiece according to claim 1, wherein the exhaust recess is a groove extending in the axial direction of the valve body shaft portion.

* * * * *